US009038744B2

(12) United States Patent
Swinford

(10) Patent No.: US 9,038,744 B2
(45) Date of Patent: May 26, 2015

(54) JET HAMMER

(75) Inventor: Jerry L. Swinford, Spring, TX (US)

(73) Assignee: COIL TUBING TECHNOLOGY, INC., Spring, TX (US)

( * ) Notice: Subject to any disclaimer, the term of this patent is extended or adjusted under 35 U.S.C. 154(b) by 1193 days.

(21) Appl. No.: 12/480,680

(22) Filed: Jun. 8, 2009

(65) Prior Publication Data

US 2009/0301744 A1 Dec. 10, 2009

Related U.S. Application Data

(60) Provisional application No. 61/059,439, filed on Jun. 6, 2008.

(51) Int. Cl.

| | |
|---|---|
| ***B23B 45/16*** | (2006.01) |
| ***B25D 9/00*** | (2006.01) |
| ***B25D 11/00*** | (2006.01) |
| ***B25D 13/00*** | (2006.01) |
| ***B25D 16/00*** | (2006.01) |
| ***E21B 4/14*** | (2006.01) |
| ***E21B 6/06*** | (2006.01) |
| *E21B 41/00* | (2006.01) |

(52) U.S. Cl.
CPC ... *E21B 4/14* (2013.01); *E21B 6/06* (2013.01); *E21B 41/0078* (2013.01)

(58) Field of Classification Search
CPC ..... E21B 1/14
USPC ..... 173/13–17, 79
See application file for complete search history.

(56) References Cited

U.S. PATENT DOCUMENTS

| | | | | | |
|---|---|---|---|---|---|
| 3,498,389 | A | * | 3/1970 | Tibbott | 173/178 |
| 3,512,590 | A | * | 5/1970 | Tibbott | 173/178 |
| 3,512,591 | A | * | 5/1970 | Kulman | 173/178 |
| 3,612,191 | A | | 10/1971 | Martini | |
| 3,724,560 | A | * | 4/1973 | Tibbott | 173/178 |
| 3,802,516 | A | * | 4/1974 | Speicher | 173/15 |
| 3,804,180 | A | * | 4/1974 | Gelfand et al. | 173/15 |
| 3,887,018 | A | * | 6/1975 | Jayne | 173/120 |
| 3,892,279 | A | | 7/1975 | Amtsberg | |
| 4,106,571 | A | | 8/1978 | Stone | |
| 4,290,489 | A | * | 9/1981 | Leavell | 173/17 |
| 4,300,282 | A | * | 11/1981 | Bunyea et al. | 29/751 |
| 4,346,770 | A | | 8/1982 | Beck | |
| 4,401,161 | A | | 8/1983 | Warren | |
| 4,494,615 | A | | 1/1985 | Jones | |
| 5,267,613 | A | | 12/1993 | Zwart et al. | |

(Continued)

*Primary Examiner* — Robert Long
(74) *Attorney, Agent, or Firm* — Keeling Patents & Trademark, LLC; Melissa M. Martinez; Kenneth A. Keeling

(57) ABSTRACT

An exemplary embodiment of the jet hammer includes an outer sleeve, impact assembly, and a valve assembly. The impact assembly is positioned in sliding relation to the outer sleeve to provide the impact of the jet hammer. The valve assembly generally comprises a cap screw, adjustment sleeve, valve port, inner compression spring, outer compression spring, and lock nut. The inner compression spring is relatively less compressible than the outer compression spring. In operation, fluid enters the valve assembly and acts on the compression springs forming an operational seal between the valve assembly and the impact assembly thereby slidingly displacing the outer sleeve from the impact assembly. Once the pressure acting on the valve assembly is released, the main compression spring decompresses forcefully causing an impact which is translated onto the obstruction or item to be struck.

20 Claims, 9 Drawing Sheets

(56) References Cited

U.S. PATENT DOCUMENTS

| | | | | |
|---|---|---|---|---|
| 6,164,393 | A * | 12/2000 | Bakke | 175/296 |
| 6,283,229 | B1 * | 9/2001 | Wentworth et al. | 175/62 |
| 6,655,568 | B2 * | 12/2003 | Thieleke | 227/8 |
| 7,055,542 | B2 * | 6/2006 | Delobel et al. | 137/219 |
| 7,156,190 | B2 | 1/2007 | Ottestad et al. | |
| 7,686,102 | B2 * | 3/2010 | Swinford | 175/107 |
| 2007/0175646 | A1 * | 8/2007 | Preston et al. | 173/13 |
| 2007/0227779 | A1 * | 10/2007 | Swinford | 175/71 |
| 2010/0078219 | A1 * | 4/2010 | Swinford | 175/57 |
| 2015/0013794 | A1 * | 1/2015 | Dirr | 137/596 |

* cited by examiner

JET HAMMER

CROSS-REFERENCE TO RELATED APPLICATIONS

This application claims the benefit of U.S. provisional application Ser. No. 61/059,439 filed on Jun. 6, 2008, which application is incorporated herein by reference as if reproduced in full below.

STATEMENT REGARDING FEDERALLY SPONSORED RESEARCH OR DEVELOPMENT

Not applicable.

BACKGROUND OF THE INVENTION

1. Field of the Invention

The invention relates generally to impact devices for use during downhole operations. More specifically, the invention is directed to an impact device capable of rotation for use with coiled tubing.

2. Description of the Related Art

The use of mechanical or fluid driven downhole impact tools, hammers, jarring tools, and percussion drilling tools is known in the art, as described in the following U.S. patents.

U.S. Pat. No. 3,612,191 to Martini discloses a fluid operated percussion drilling tool that uses drill bit jet nozzles for hole bore cleaning, as well as for rotary drilling of petrochemical and other wells, geophysical and construction holes, and the like.

U.S. Pat. No. 3,892,279 to Amtsberg discloses a reciprocating hydraulic hammer that utilizes a piston, a plunger to return the hammer, dampers to dampen excessive movement of the hammer, and an ram to shift a control valve.

U.S. Pat. No. 4,106,571 to Stone discloses a pneumatic impact drilling tool that includes a reciprocating hammer, an anvil positioned under the hammer, and a feeder tube extending through the hammer. The feeder tube directs the flow of fluid through ports in the hammer to alternate pressure on opposite sides of the hammer to move it upward and downward relative to the anvil. The air inlet end of the tube is also provided with air jet passages extending upward and outwardly and having check valves operated in the outflow direction.

U.S. Pat. No. 6,164,393 to Bakke discloses a hydraulic impact tool that utilizes a movable hammer that prestresses a spring by means of a hydraulic piston. Hydraulic force from pressurized fluid displaces the piston and the hammer and prestresses the spring. When released, the prestressed spring drives the hammer to strike, and at the same time the piston returns to its initial position. The process is then repeated.

U.S. Pat. No. 7,156,190 to Ottestad, et al. discloses an impact tool having a slidable hammer that is driven by hydraulic oil under pressure. The hydraulic oil is pressurized by a piston driven by compressed gas on the opposite side of the piston from the hydraulic oil. As the piston moves to compress the gas, it lifts a valve that opens a passage for the hydraulic oil moved by the piston to act on a hammer to impact a breaking tool.

U.S. Pat. No. 4,346,770 discloses a hydraulic jarring tool using a vortex fluid jet and a longitudinally slidable inner mandrel within an outer case. The mandrel has a hammer element which impacts an anvil in the case. Hydraulic fluid is disposed between the case and the mandrel. Initial movement of the mandrel in the case is impeded by a hydraulic fluid metering jet mechanism, which is bypassed as the mandrel reaches a predetermined point in its travel.

U.S. Pat. No. 4,401,161 to Warren discloses an oil well tool retrieving device or jar that includes a cylindrical hammer slidable within a hollow casing. The hammer engages impact surfaces within the casing. The hammer is supported by a cylindrical mandrel slidable in the casing.

U.S. Pat. No. 4,494,615 to Jones discloses an oil field jarring tool that includes a barrel and a mandrel interconnected by a ball transfer mechanism. Pulling upward on the jar causes a ring spring assembly to be stressed. As the spring assembly reaches its limit of stroke, the ball transfer mechanism trips so that the mandrel moves relatively freely with respect to the barrel. A hammer and an anvil carried by the mandrel and barrel then impact to create an upwardly directed jar on the fish to which the tool is connected. The ball transfer mechanism includes a plurality of balls which move both axially and radially of the tool during operation.

U.S. Pat. No. 5,267,613 to Zwart, et al., discloses an upstroke jar for use in downhole operations which comprises a casing defining an anvil and for connection to the tool, a hammer slidable axially within the casing for impacting with the anvil and for connection to a wireline, a hammer holder, a spring arrangement located between an abutment on the casing and an abutment on the hammer holder for compression on an operative movement of the hammer holder as a consequence of tension on the wireline. A connector is releasable to free the hammer from the holder at the completion of the operative movement, so that the freed hammer may impact with the anvil. The compression load on the spring present at the release is dependant on the extent of the operative movement from a rest position and the degree of compression of the spring means to obtain the operative movement. Adjustment of the release load present at the instant the hammer part is released by the connector is provided.

BRIEF SUMMARY OF THE INVENTION

An exemplary embodiment of the jet hammer includes an outer sleeve, impact assembly, and a valve assembly. The impact assembly is positioned in sliding relation to the outer sleeve to provide the impact of the jet hammer. The impact assembly may also be capable of rotational movement with respect to the outer sleeve. The valve assembly generally comprises a cap screw, adjustment sleeve, valve port, inner compression spring, outer compression spring, and lock nut. The inner compression spring is relatively less compressible than the outer compression spring. In operation, fluid enters the valve assembly and acts on the compression springs forming an operational seal between the valve assembly and the impact assembly. In response, the outer sleeve is slidingly displaced from the impact assembly thereby compressing a main compression spring positioned along the mandrel shaft. Once the pressure acting on the valve assembly is released, the main compression spring decompresses forcefully causing the outer sleeve to impact a connection port, bit, tool, or other member attached to the upper end of the mandrel. This impact is translated onto the obstruction or item to be struck.

A further exemplary embodiment comprises a mandrel shaft that contains rotation nozzles thereon. The rotation nozzles allow for fluid communication from the mandrel's internal bore, through the nozzles, and against the proximate inner wall of the outer sleeve. This interaction causes the mandrel, and by connection the connection port, bit, tubing, or tool attached thereto, to rotate during the downward stroke of the hammer. Rotation nozzles may be located on the connection port and/or bit for additional rotational force.

Other features and advantages of the various embodiments of the invention will be apparent from the following detailed description, the accompanying drawings, and the appended claims.

BRIEF DESCRIPTION OF THE DRAWINGS

For a more complete understanding of the embodiments of the invention, reference is now made to the following Detailed Description of Various Embodiments of the Invention, taken in conjunction with the accompanying drawings, in which.

DETAILED DESCRIPTION OF VARIOUS EMBODIMENTS OF THE INVENTION

Figure 1:
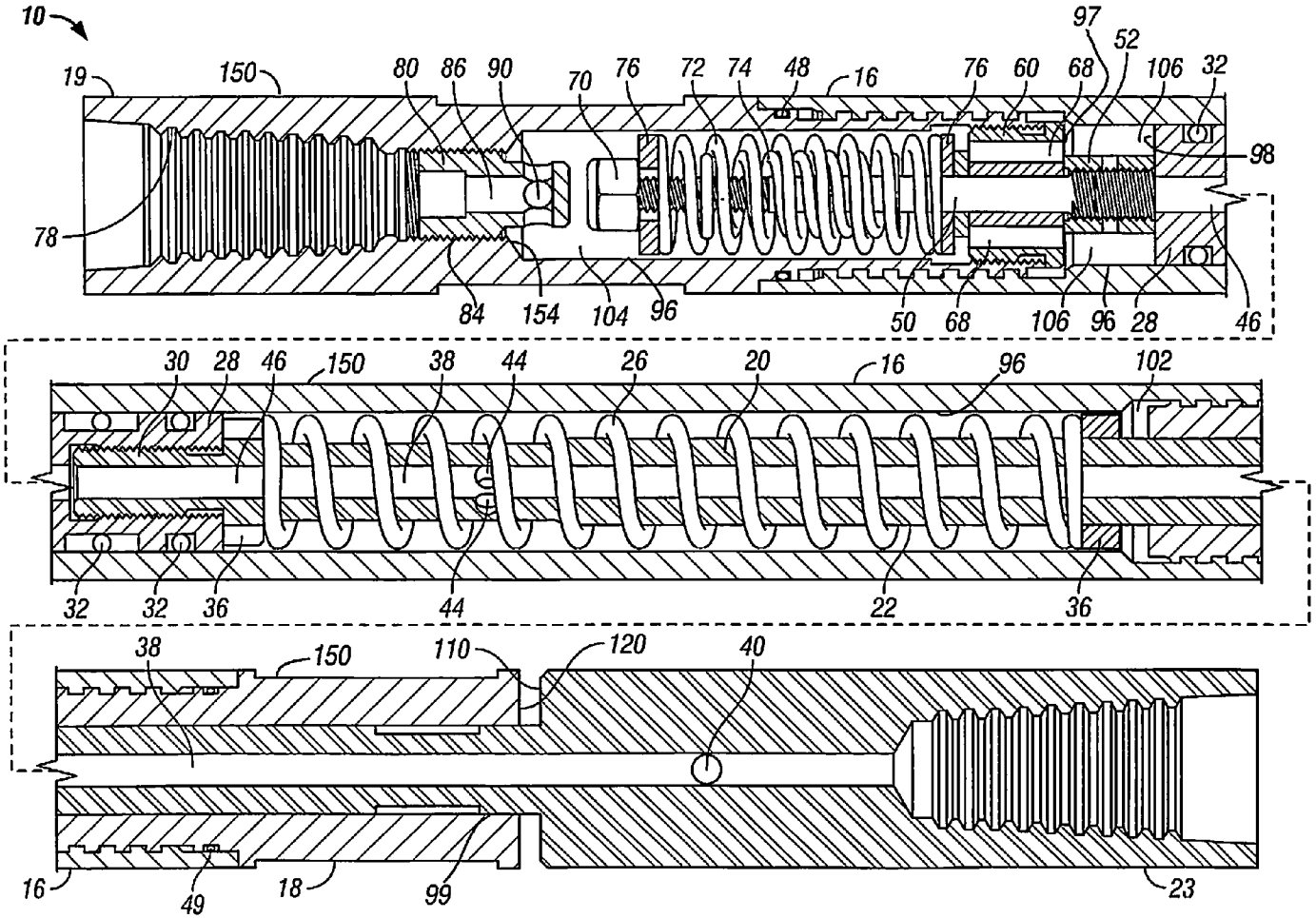
FIG. 1 is a longitudinal, partial cross-sectional view of an exemplary embodiment of a jet hammer in a substantially retracted position, taken along the centerline of the tool.
Figure 2:
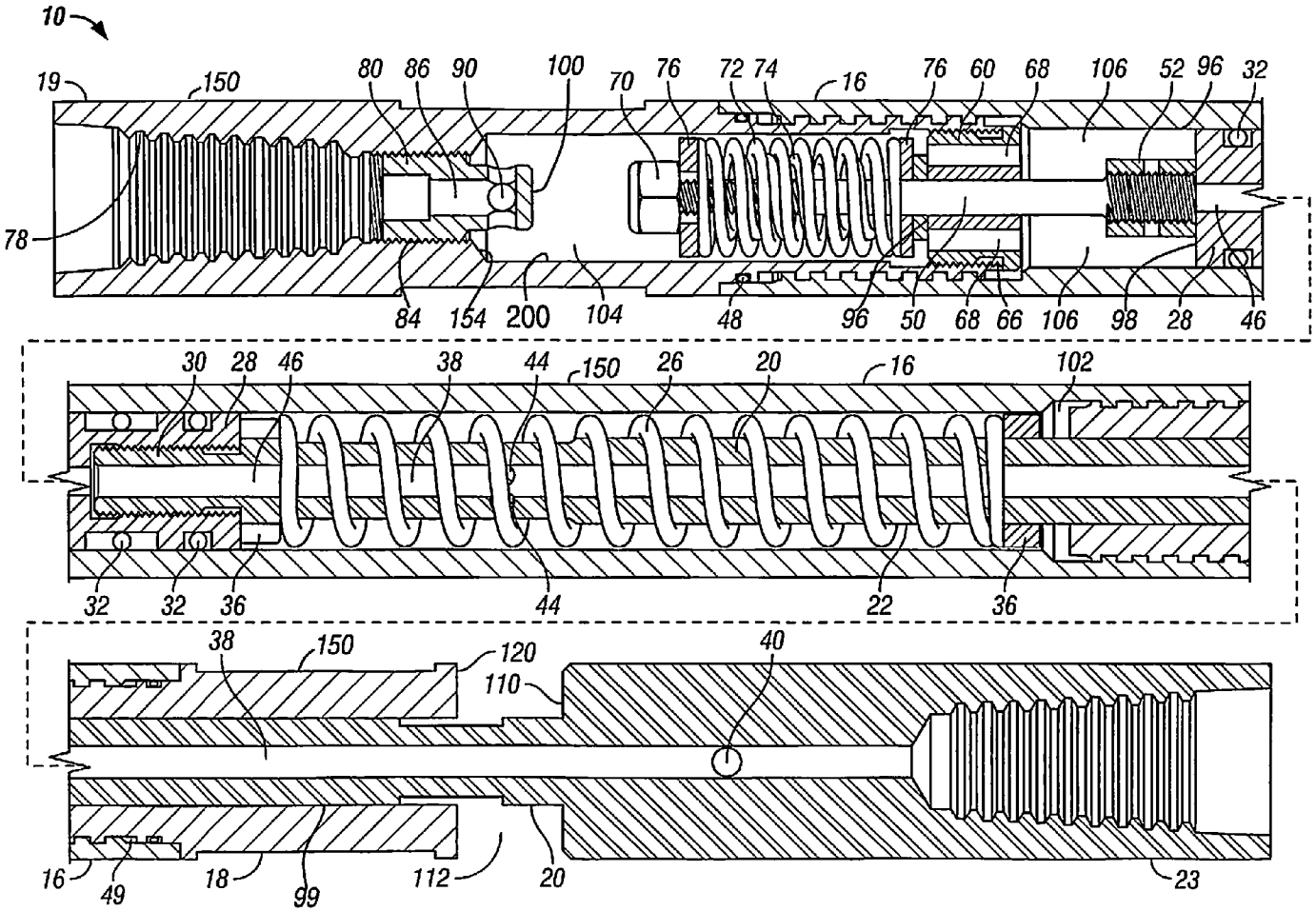
FIG. 2 is a longitudinal, partial cross-sectional view of the exemplary embodiment of FIG. 1 in a substantially extended position.
Figure 3:
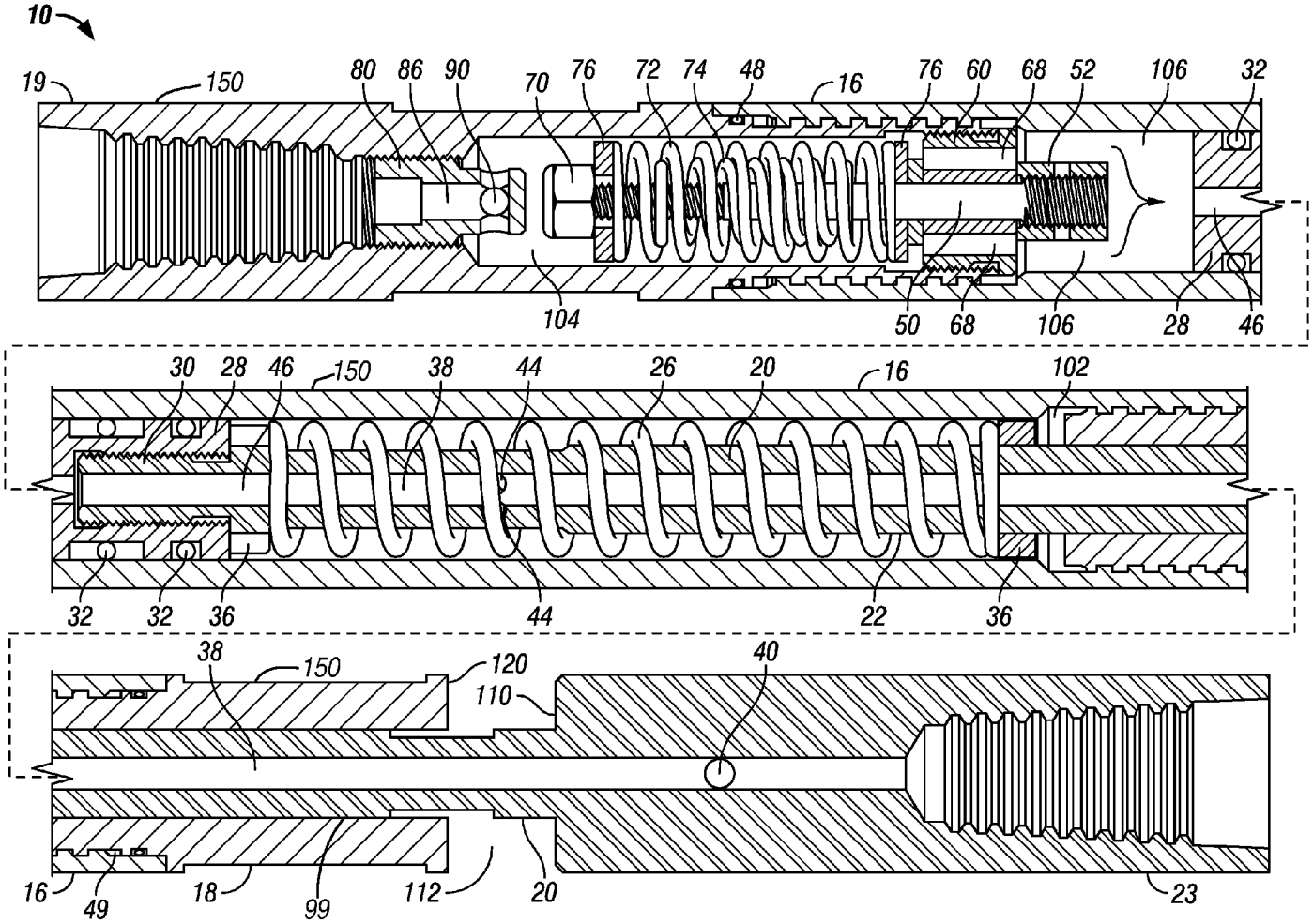
FIG. 3 is a longitudinal, partial cross-sectional view of the exemplary embodiment of FIG. 1 shortly after the initiation of the downstroke of the hammer.

The described exemplary and alternative embodiments of the invention are best understood by referring to the drawings, like numerals being used for like and corresponding parts of the various drawings. In FIGS. 1, 2, and 3 there is shown, in longitudinal cross-sectional view, an exemplary embodiment of a jet hammer, generally designated 10. The exemplary embodiment of the jet hammer 10 generally includes an upper sub 19, a barrel 16, a valve assembly 14 (see FIG. 6), and an impact assembly 12 (see FIG. 5) all having a common central axis.

As used herein, "upper" will refer to the direction of the upper sub 19 that connects to a drill string or tubing (not shown). As used herein, "lower" will refer to the direction of the obstruction or structure to be impacted distal the upper sub 19.

Referring to FIG. 1, the jet hammer 10 contains an outer sleeve 150 that is generally comprised of the upper sub 19, the barrel 16, and the lower sub 18. The outer sleeve 150 contains an interior sleeve surface that extends generally along the axially extending inner bore of the upper sub 19, barrel 16, and the lower sub 18. The upper sub 19 is constructed for removable attachment at its upper end to the drill string, tubing or similar conduits (not shown) allowing for fluid flow therethrough. The upper sub 19 is attached to the barrel 16 at the lower end of the upper sub 19 and the upper end of the barrel 16. The lower sub 18 is attached to the barrel 16 distal the upper sub 19 at the lower end of the barrel 16.

Figure 7A:
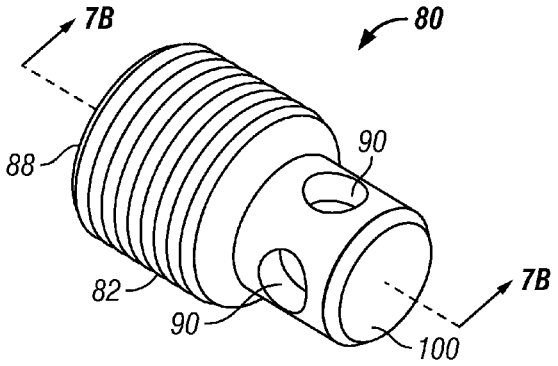
FIG. 7A is a perspective view of an exemplary embodiment of the fluid inlet screw.
Figure 7B:
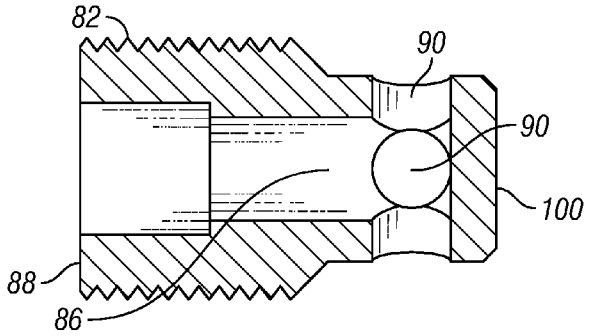
FIG. 7B is a cross-sectional view of the fluid inlet screw of FIG. 7A.

Referring to FIGS. 1, 7A, and 7B, a fluid inlet member 80 is functionally connected within the upper sub 19. The fluid inlet member 80 is positioned proximate the upper connection end of the upper sub 19. The fluid inlet member 80 contains an axial bore 86 that is open to the upper inlet end 88 and allows the passage of fluid into inlet end 88 and through at least one fluid port 90. The at least one fluid port 90 is positioned near the head 100 of the fluid inlet member 80 and is substantially perpendicular to the axial bore 86. The fluid exits the at least one fluid port 90 and enters the upper pressure chamber 104.

Figure 6:
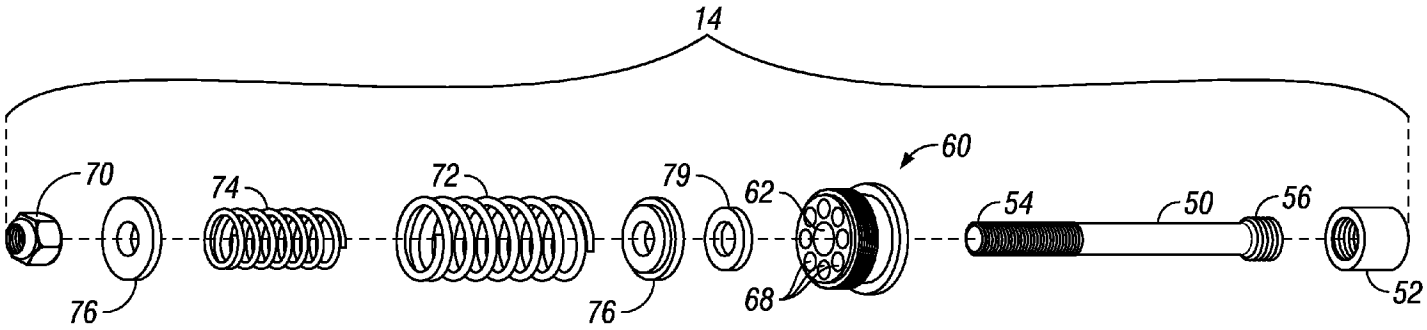
FIG. 6 is an exploded view of an exemplary valve assembly.

Referring to FIGS. 1 and 6, the valve assembly 14 generally includes an adjustment sleeve 52, a cap screw 50, a valve port 60, an outer compression spring 72, an inner compression spring 74, and a lock nut 70. The cap screw 50 is a generally elongated, cylindrical member with an upper end 54 and an opposite lower end 56. The adjustment sleeve 52 is attached to the lower end 56 of the cap screw 50.

The valve port 60 is a generally cylindrical member containing a central bore 62 therethrough. The valve port 60 is slidable in relation to the cap screw 50, wherein the cap screw 50 is inserted through the central bore 60 such that the valve port 60 is positioned adjacent the upper end 54 of the cap screw 50. The valve port 60 contains at least one peripheral bore 68 which is provided in the body of the valve port 60 and is spaced around the central bore 62 to permit fluid flow through the valve port 60.

The inner compression spring 74 is smaller than the outer compression spring 72 both in length and in width, such that the inner compression spring 74 may fit within the outer compression spring 72 when both springs 72, 74 are concentrically positioned around the cap screw 50 intermediate the valve port 60 and the upper end 54 of the cap screw 50. The compression springs 72, 74 are slidable in relation to the cap screw 50.

The lock nut is attached to the upper end 54 of the cap screw 50 in order to retain the valve port 60, inner compression spring 74, and outer compression spring 72 intermediate the lower end 56 and the lock nut 70.

The valve assembly 14 may further contain a pair of spring supports 76. The spring supports 76 are generally circular members containing an orifice therethrough. The spring supports 76 may further contain a protrusion 94 proximate the corresponding end of outer compression spring 72. The concentrically contained inner compression spring 74 and outer compression spring 72 are positioned intermediate the spring supports 76 when positioned on the cap screw 50. The protrusion 94 of the spring supports 76 at least partially extends within the corresponding ends of the outer compression spring 72 thereby substantially preventing lateral movement of the outer compression spring 72. Due to the relatively shortened length of the inner compression spring 74 in relation to the outer compression spring 72, the spring supports 76 do not physically touch both free ends of the inner compression spring 74 when the valve assembly 14 is in its initial, uncompressed position, as seen in FIG. 1. One or more washers 79 may be utilized in connection with the valve assembly 14 as needed.

The lower end 56 may contain a slightly larger outer diameter than that of the remaining cap screw 50 member. A purpose of which is to prevent passage of the valve port 60 over the threaded lower end 56. A purpose of the ends 54, 56 is to retain the components of the valve assembly 14 in a functioning relationship on the cap screw 50.

Once the valve assembly 14 is assembled, the lock nut 70 and/or the adjustment sleeve may be adjusted such that the necessary pretension in the outer compression spring 72 required to allow for the proper fluid flow and pressure retention within the valve assembly system may be set. The frequency of the impact strikes may be at least partially controlled through the pretension of the outer compression spring 72 and/or inner compression spring 74. The lower end of the upper sub 19 contains internal threading 66 thereon. The valve port 60 is attached to the upper sub 19 by the threaded connection of the internal threading 66 of the upper sub 19 with the external threading 64 of the valve port 60, whereby the lock nut 70 is positioned adjacent the head 100 of the fluid inlet member 80, and the adjustment sleeve 52 is positioned external of the internal bore of the upper sub 19.

The seat 154 for the fluid inlet member 80, the base of the valve port 60, and the interior walls 200 of the upper sub 19 intermediate thereof define the upper pressure chamber 104. The inner compression spring 74, outer compression spring 72, and lock nut 70 of the valve assembly 14 are contained within the upper pressure chamber 104.

A purpose of the valve assembly 14 is to initiate the impact strokes of the jet hammer 10 by regulating the flow of fluid from the upper sub 19 through the mandrel 20.

Figure 5:
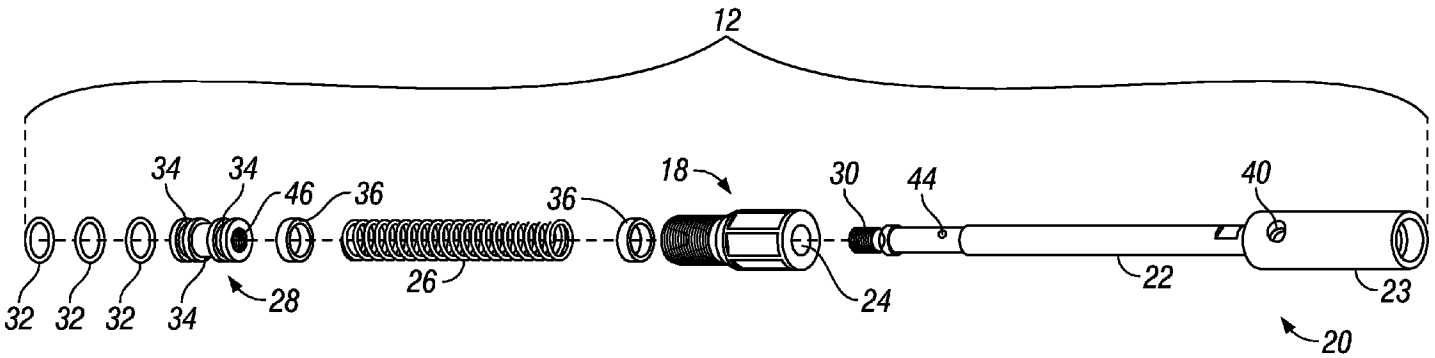
FIG. 5 is an exploded view of an exemplary impact assembly.

Referring to FIGS. 1 and 5, the impact assembly 12 generally includes a mandrel 20, a main compression spring 26, and a piston 28. The impact assembly 12 is at least partially contained within the barrel 16. The mandrel 20 is comprised of a mandrel shaft 22 and a connection port 23. The mandrel 20 is a generally elongated, cylindrical member having a longitudinally extending internal bore 38 therethrough. The connection port 23 of the mandrel 20 is constructed with a larger outer diameter with respect to the mandrel shaft 22. The impact surface 110 of the connection port 23 acts as the anvil during the impact phase, thereby translating the impact to the lower end of the jet hammer 10.

The lower sub 18, of the outer sleeve 150, contains the main compression spring 26 of the impact assembly 12 securely against the piston 28. The lower sub 18 is a generally cylindrical member containing a bore 24 therethrough. The lower sub 18 has a threaded upper end for attachment to the lower end of the barrel 16. The lower sub 18 acts as the hammer during operation wherein the hammer surface 120 of the lower sub 18 strikes the impact surface 110 of the connection port 23 thereby imparting an impact at the lower end of the jet hammer 10. The shaft 22 of the mandrel 20 fits within the bore 24 of the lower sub 18 allowing for sliding movement therein. However, the fit between the shaft 22 of the mandrel 20 and the bore 24 of the lower sub 18 is loose enough to permit some fluid flow therebetween through gap 99.

The main compression spring 26 is sized and shaped to fit over the shaft 22 of the mandrel 20 for sliding movement thereon. The piston 28 is generally cylindrical having a longitudinally extending bore 46 therethrough. The piston 28 is attached to the upper end 30 of the mandrel 20. At least one o-ring 32 is positioned on at least one groove 34 to form a slidable seal between the piston 28 and the barrel 16. The seal created by the at least one o-ring 32 is sufficient to prevent excess fluid flow through the interior of the barrel 16 past the exterior of the piston 28, but nonrestrictive enough to allow for movement, such as axial and/or rotational movement, of the impact assembly 12 in relation to the outer sleeve 150.

The impact assembly 12 may further contain a pair of spacers 36. The spacers 36 are generally circular members containing an orifice therethrough for positioning around the mandrel shaft 22. The spacers 36 are fitted on the mandrel shaft 22 at each end of the main compression spring 26 for sliding movement on the mandrel shaft 22. The spacers 36 are contained intermediate the piston 28 and the threaded end 92 of the lower sub 18.

The connection port 23 of the mandrel 20 is generally cylindrical and is internally threaded at its lower end for attachment to a bit 140, tubing, tool, or the like (not illustrated).

The impact assembly 12, with the lower sub 18 intermediate the connection port 23 and main compression spring 26, is inserted, piston end first, into the internal bore of the barrel 16 at the lower end of the barrel 16. The lower sub 18 is threadedly attached to the lower end of the barrel 16 through its threaded end 92. In position, the piston 28 is disposed adjacent the adjustment sleeve 52 of the valve assembly 14. The face 97 of the valve port 60, the base 98 of the piston 28, and the interior walls 96 of the barrel 16 intermediate thereof define the lower pressure chamber 106.

Referring to FIG. 1, at least one o-ring 48 is positioned between the barrel 16 and the upper sub 19 when they are attached to each other. This at least one o-ring 48 may form a seal therebetween. At least one o-ring 49 is positioned between the barrel 16 and the lower sub 18 when these parts are connected together. This at least one o-ring 49 may form a seal between the barrel 16 and the lower sub 18.

The mandrel 20 and the piston 28 are slidable within the outer sleeve 150, which is generally comprised of the upper sub 19, the barrel 16, and the lower sub 18. The main compression spring 26 is compressible between the piston 28 and the lower sub 18, and therefore somewhat slidable, within the outer sleeve 150.

The mandrel 20 and the piston 28 may be rotatable in relation to the outer sleeve 150. The main compression spring 26 and/or the spacers 36 may also be rotatable in relation to the outer sleeve 150.

At least one upper rotation nozzle 44 extends through the wall of the mandrel shaft 22. In an exemplary embodiment, at least two upper rotation nozzles 44 are provided spaced within the wall of the mandrel shaft 22. The at least one upper rotation nozzles 44 are in fluid communication with the internal bore 38 of the mandrel 20.

The upper rotation nozzles 44 are located on the mandrel shaft 22 intermediate the piston 28 and the connection port 23. The upper rotation nozzles 44 allow fluid flow from the internal bore 38 of the mandrel 20, through the upper rotation nozzles 44, and through the gap 99 between the lower sub 18 and the mandrel shaft 22.

Figure 8A:
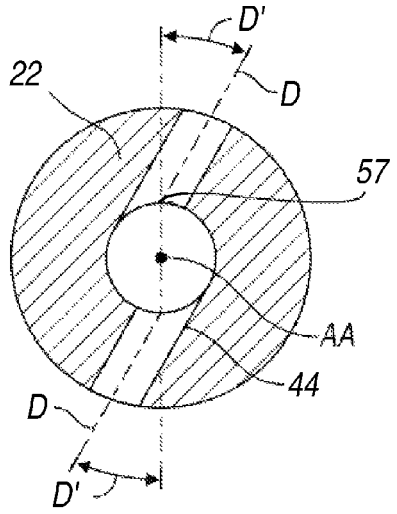
FIG. 8A is a cross-sectional view of the mandrel shaft taken at the rotation nozzles.

Referring to FIG. 8A, axes D of the at least one upper rotation nozzle 44 are each angled acutely from a plane along, and substantially parallel to, axis AA, that passes through the interior opening 57 of the at least one upper rotation nozzle 44, to provide rotational thrust in a desired direction. Specifically, the angle D' of each axis D with respect to the plane is acute in relation to the plane. The exiting fluid through the at least one upper rotation nozzle 44, contacts the inner wall 96 of the barrel 16 proximate the nozzle 44 at a pressure sufficient to produce rotation of the mandrel 20 in the desired location. The rotation of the mandrel shaft 22 will also rotate the connection port 23 and any members connected thereto.

Reverse rotation may be achieved by manipulating the angle of the at least one upper rotation nozzle 44 to produce such result.

Figure 8B:
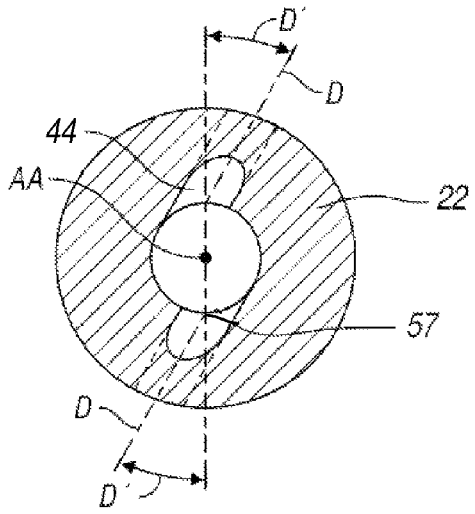
FIG. 8B is a cross-sectional view of an alternative embodiment of the rotation nozzles on the mandrel shaft.

Referring to FIG. 8B, alternatively axes D of the at least one upper rotation nozzles 44 may also each be oriented rearward with respect to axis AA. The angle being acute in the direction of upper sub 19 and obtuse with respect to the connection port 23. Accordingly, the at least one upper rotation nozzles 44 are each oriented rearward from a plane substantially perpendicular to axis AA at the interior opening 57 of each upper rotation nozzle 44. Such orientation may provide a forward thrust produced from fluid escaping through the upper rotation nozzles 44 and impacting the inner wall 96 of the barrel 16.

Figure 9A:
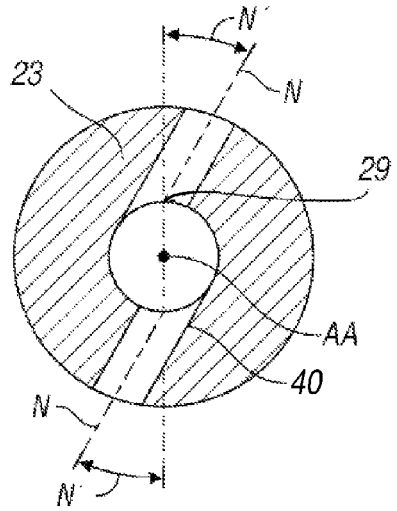
FIG. 9A is a cross-sectional view of the connection port at the rotation nozzles.

Referring to FIG. 9A, the connection port 23 may also contain at least one lower rotation nozzle 40 disposed in the wall of the connection port 23. In an exemplary embodiment at least two lower rotation nozzles 40 are provided. The lower rotation nozzles 40 are in fluid communication with the internal bore 38 of the mandrel 20 and allow fluid flow from the internal bore 38 to the exterior of the connection port 23.

The at least one lower rotation nozzle 40 each has an axis N. Axes N are each disposed generally perpendicularly in respect to axis AA. Axes N of the rotation nozzles 40 are each angled acutely from a plane along, and substantially parallel to, axis AA, that passes through the interior opening 29 of the at least one lower rotation nozzle 40, to provide rotational thrust in a desired direction. Specifically, the angle N' of each axis N with respect to a plane passing through axis AA at the interior opening 29 is acute in the preferred direction of rotation. The exiting fluid through the at least one lower rotation nozzle 40, contacts the interior of the downhole wellbore proximate the lower rotation nozzle 40 at a pressure sufficient to produce rotation of the mandrel 20 in the desired location. The rotation of the connection port 23 will also rotate any members connected thereto.

Reverse rotation may be achieved by manipulating the angle of the at least one lower rotation nozzle 40 to produce such result.

Figure 9B:
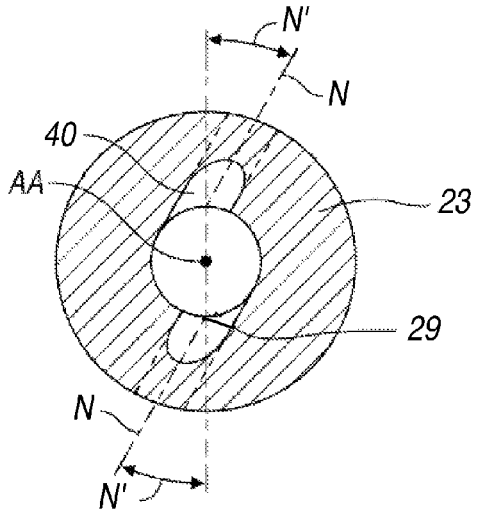
FIG. 9B is a cross-sectional view of an alternative embodiment of the rotation nozzles on the connection port.

Referring to FIG. 9B, alternatively axes N of the at least one lower rotation nozzles 40 may also each be oriented rearward with respect to axis AA. The angle being acute in the direction of the upper sub 19 and obtuse with respect to the direction of the impact point. Accordingly, the at least one lower rotation nozzles 40 are each oriented rearward from a plane substantially perpendicular to axis AA at the interior opening 29 of each lower rotation nozzle 40. Such orientation may provide a forward thrust produced from fluid escaping through the lower rotation nozzles 40 and impacting the surrounding downhole wellbore.

In an alternative embodiment, at least one fluid port 90 is positioned on the head 100 of the fluid inlet member 80. Alternatively, at least one fluid port 90 is positioned on the head 100 of the fluid inlet member 80 and is substantially parallel to the axial bore 86, and at least one fluid port 90 is positioned near the head of the fluid inlet member 80 and is substantially perpendicular to the axial bore 86.

Figure 10:
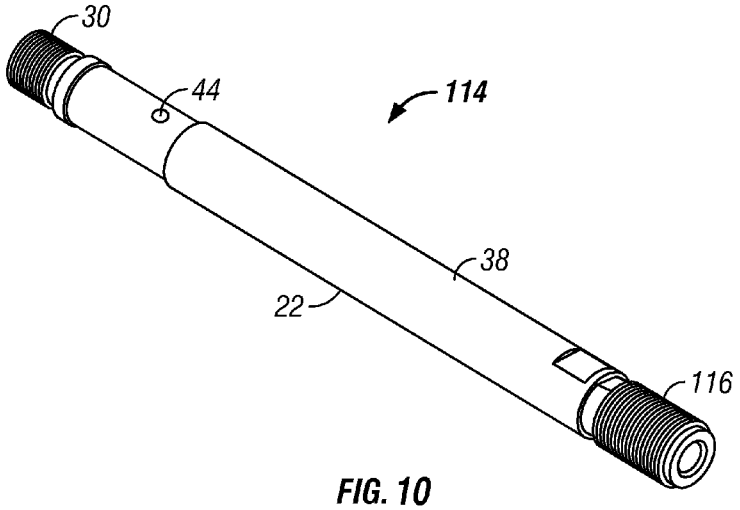
FIG. 10 is a perspective view of a mandrel according to an alternative embodiment of the invention.
Figure 11A:
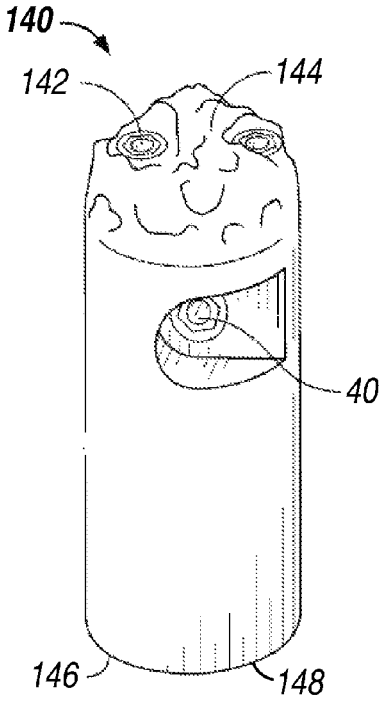
FIG. 11A is a perspective view of an exemplary bit.
Figure 11B:
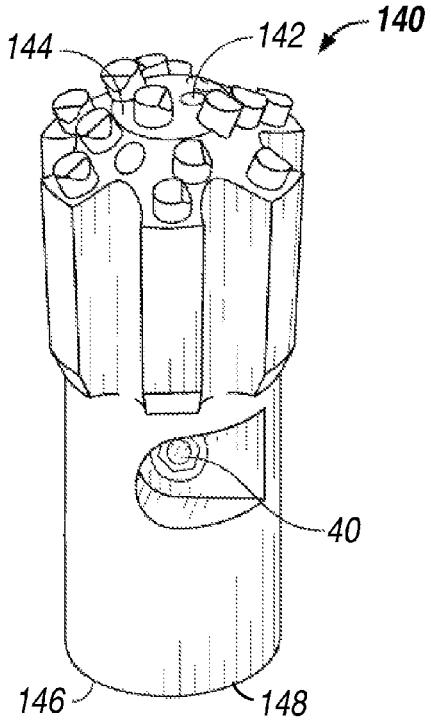
FIG. 11B is a perspective view of an alternative bit.

Referring to FIGS. 10, 11A, and 11B, in an alternative embodiment, the mandrel 114 does not contain a connection port 23. The lower portion of the mandrel 114 contains a threaded end 116 for connection to a bit 140, tubing, tool, or the like. A bit 140, such as the one depicted in FIG. 11A or FIG. 11B, may be attached to the mandrel 114 at the threaded end 116. The bit 140 may contain at least one lower rotation nozzle 40 as described previously. The bit 140 may further contain cutting nozzles 142 provided in the bit face 144. Cutting nozzles 142 are in fluid communication with the internal bore 146 of the bit 140. Fluid escaping from nozzles 142 provide cutting forces and wash loose materials away from bit face 144. The impact surface 148 of the bit is struck by the hammer surface 120 of the lower sub 18 during each impact of the jet hammer 10.

Figure 12:
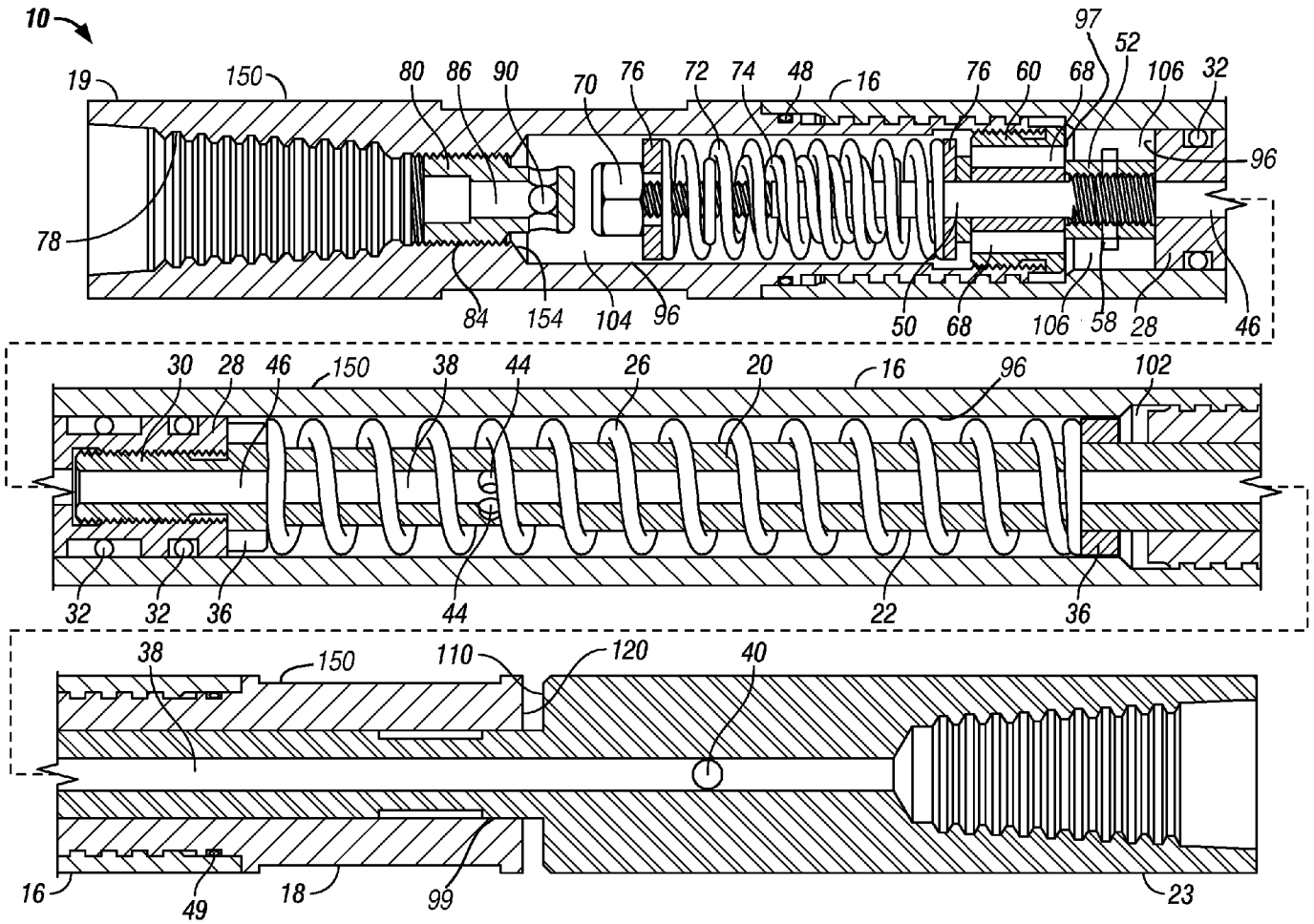
FIG. 12 is a partial cross-sectional view of an alternative embodiment of the jet hammer in a substantially retracted position.

Referring to FIG. 12, in an alternative embodiment, an aperture for receiving a connecting member 58 may transverse the adjustment sleeve 52 and the threaded lower end 56 of the cap screw 50. The connecting member 58 may be inserted through the aligned receiving apertures in the adjustment sleeve 52 and the lower end 56 of the cap screw 50 in order to affix the adjustment sleeve 52 to the threaded lower end 56 once the desired pretension is introduced into the outer compression spring 72.

In a further alternative embodiment, an aperture for receiving a connecting member 58 may transverse the lock nut 70 and the upper end 54 of the cap screw 50. The connecting member 58 may be inserted through the aligned receiving apertures in the lock nut 70 and the upper end 54 in order to affix the lock nut 70 to the upper end 54.

The connecting member may be any number of known connectors capable of affixing the adjustment sleeve 52 to the lower end 56 of the cap screw 50 and/or the lock nut 70 to the upper end 54 of the cap screw 50. The connectors may include, but are not limited to, spring pins, cotter pins, and the like.

The various attachments referred to herein may be threaded as shown or achieved by any other known means for attaching one component to the corresponding component. The various attachments may also be removably or fixedly attached.

In use, the jet hammer 10 is first threadedly attached to the lower end of a drill string (not shown), either directly or though other tools and/or tubing, and then lowered downhole to a portion of the wellbore to be cleaned or cleared of an obstruction. Compressed air, nitrogen, water, light drilling fluid, or other suitable fluid is then introduced from the drill string into the jet hammer 10 through the upper opening in upper sub 19.

Referring to FIG. 1, the jet hammer 10 is initially in its retracted, uncompressed position. In this configuration, main compression spring 26, inner compression spring 74 and outer compression spring 72 are in their resting, uncompressed positions. Main compression spring 26 may be pre-tensioned to allow for suitable compression to achieve the desired impact force. The lower end of the compression spring 26 bears against the upper end 102 of the lower sub 18 through spacer 36, and the upper end of the compression spring 26 bears against the piston 28 through the opposite spacer 36. Similarly the outer compression spring 72 and/or inner compression spring 74 may be pre-tensioned as necessary.

Referring to FIGS. 1 and 2, in operation, the fluid enters through the upper end of upper sub 19 and flows through the at least one fluid port 90 into the upper compression chamber 104. The fluid flows continues through the at least one peripheral bore 68 of the valve port 60 and into the lower pressure chamber 106. The fluid pushes against the piston 28. Some fluid may flow past the adjustment sleeve 52 and piston 28, prior to the sealing of the passage therethrough, and into the internal bore 46 of the piston 28 and on to the internal bore 38 of the mandrel 20. The pressure in the upper and lower pressure chambers 104, 106 will increase thereby compressing outer compression spring 72 and pushing the adjustment sleeve 52 via cap screw 50 against the piston 28 forming a functional seal, thereby preventing significant fluid flow through to the internal bore 46 of the piston 28.

The pressure in the upper pressure chamber 104 will increase thereby further compressing the outer compression spring 72 and forcing the adjustment sleeve 52 to push against the piston 28 via the cap screw 50. As the adjustment sleeve 52 is pushed against the piston 28, thereby pushing the impact assembly 12 down into the obstruction, the upper sub 19, the barrel 16, and the lower sub 18, collectively the outer sleeve 150, will slide over the impact assembly 12 and pull upward away from it thereby compressing the main compression spring 26 and increasing the gap 112 between the lower sub 18 and the connection port 23. The pressure moving the impact assembly 12 down into the obstruction, or area to be impacted, may provide an initial impact force dependent on the force with which the impact assembly 12 is forced downward.

Referring to FIGS. 2 and 3, the main compression spring 26 and the outer compression spring 72 are depicted in FIG. 2 in their nearly fully compressed states. The inner compression spring 74 is stiffer in relation to the outer compression spring 72 and does not compress as readily as the outer compression spring 72. Once the inner compression spring 74 begins to be compressed, the pressure in the lower pressure chamber 106 against the base 98 of the piston 28 increases due to the resistance of the inner compression spring 74 to compression. Once the necessary pressure is reached, the seal between the piston 28 and the adjustment sleeve 52 is broken, due to the pressure within the lower pressure chamber 106 acting on the face 97 of the valve port 60 and on the base 98 of the piston 28. The pressure contained in the lower pressure chamber 106 increases and pushes the valve port 60 and the piston 28 apart thereby causing the valve assembly 14, due at least in part to the stiffness of the inner compression spring 74, to move away from the piston 28, functionally breaking the seal between the adjustment sleeve 52 and the piston 28. The fluid within the lower pressure chamber 106 and the upper pressure chamber 104 is then allowed to flow through the internal bore 46 of the piston 28 and into the internal bore 38 of the mandrel 20.

Figure 4:
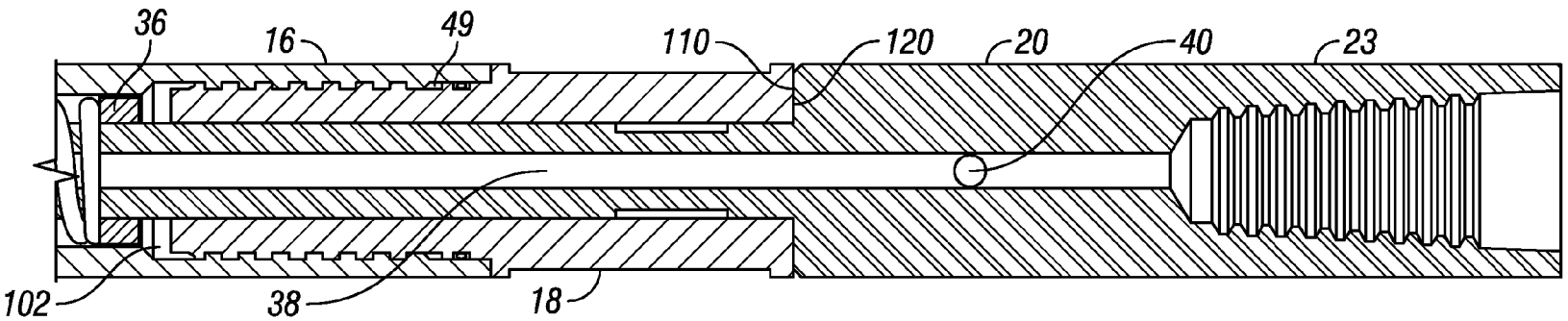
FIG. 4 is a cross-sectional view of the lower sub and connection port of the mandrel at the point of impact.

Referring to FIGS. 3 and 4, the pressure is relieved in the upper and lower pressure chambers 104, 106 due to the release of fluid into and through the internal bore 46 of the piston 28 caused by the release of the piston 28 and adjustment sleeve 52 seal. The inner compression spring 74 and the outer compression spring 72 decompress thereby pulling the adjustment sleeve 52 back against the face 97 of the valve port 60. The release of the pressure through the internal bore 38 of the mandrel 20 decompresses the main compression spring 26 thereby forcefully closing the gap 112 between the lower sub 18 and the connection port 23, and causing the hammer surface 120 of the lower sub 18 to impact the impact surface 110 of the connection port 23. This impact force results in an impact against the obstruction.

This process is repeated rapidly in succession to produce the desired effect.

When the jet hammer 10 embodiment contains upper and/or lower rotation nozzles 44, 40, then some of the fluid flow through the internal bore 38 of the mandrel 20 forcibly escapes through the upper and/or lower rotation nozzles 44, 40 and this causes rotation of the mandrel 20 and the connected port 23 thereby causing rotation in the bit 140 or other tool or tubing attached thereto.

Alternatively, the bit 140 may be directly attached to the mandrel 114. The fluid flow through rotation nozzles 44 and/or 40 will rotate the bit 140 and aid in the impact of the jet hammer 10.

In an exemplary embodiment, the bit 140 rotates about fifteen degrees with each impact.

In an alternative embodiment, the bore 38 in the connection port 23, or the bit 140, is plugged on its lower end, forcing all the fluid entering the bore 38 to exit through rotation nozzles 40 and 44.

The term spring as used herein refers to any resilient member of any shape that is operable in the invention, and may be made from any elastic material. The springs may be comprised of a compressible fluid.

In one example embodiment of the invention, the parts described above comprise oilfield tool quality steel, and barrel 16 is provided with a quenched-polished-quenched ("QPQ") surface hardened coating.

An exemplary jet hammer 10 according to this invention having an overall diameter of 3.5 cm (1.375 inch) and a piston diameter of 2.54 cm (1.0 inch), when operated with air at 500 psi inlet pressure, will provide approximately 1500 impacts per minute, and will provide approximately 30 to 40 revolutions per minute to the mandrel and connected tool.

Various changes or modifications may be made to the disclosed embodiments without departing from the true spirit and scope of the invention as contained within the scope of the appended claims. It is understood that the invention is only limited by the claims and their equivalents.

What is claimed is:

1. An impact tool valve assembly, comprising:

a cap screw having an upper end and a lower end;

a valve port having at least one peripheral bore allowing fluid passage therethrough, wherein said valve port is slidingly disposed in relation to said cap screw;

an outer compression spring, and an inner compression spring slidably disposed within said outer compression spring; and said inner compression spring and said outer compression spring concentrically positioned around said cap screw in a slidable relation intermediate said valve port and said upper end of said cap screw.

2. The impact tool valve assembly of claim 1, further comprising:

an adjustment sleeve attached to said lower end of said cap screw adjacent said valve port.

3. The impact tool valve assembly of claim 2, wherein said outer compression spring is pre-tensioned for operation by manipulation of said adjustment sleeve.

4. The impact tool valve assembly of claim 3, further comprising:

a connection member, wherein said adjustment sleeve is contained on said lower end of said cap screw by said connection member.

5. The impact tool valve assembly of claim 1, further comprising:

a lock nut attached to said upper end of said cap screw proximate said outer compression spring; and wherein said inner compression spring is smaller in length and width than said outer compression spring.

6. The impact tool valve assembly of claim 5, wherein said outer compression spring is pre-tensioned for operation by manipulation of said lock nut.

7. The impact tool valve assembly of claim 1, wherein said inner compression spring is less compressible than said outer compression spring.

8. An impact tool, comprising:

an outer sleeve having a hammer surface;

an impact assembly having an impact surface proximate said hammer surface;

said impact assembly at least partially retained within said outer sleeve;

said impact assembly movable in relation to said outer sleeve;

a main compression spring;

a valve assembly;

said main compression spring slidably disposed along said impact assembly intermediate said impact surface and said valve assembly;

wherein said valve assembly comprises;

a cap screw having an upper end and a lower end;

a valve port having at least one peripheral bore allowing fluid passage therethrough, wherein said valve port is slidingly disposed in relation to said cap screw;

an outer compression spring, and an inner compression spring slidably disposed within said outer compression spring; and said inner compression spring and said outer compression spring concentrically positioned around said cap screw in a slidable relation intermediate said valve port and said upper end of said cap screw.

9. The impact tool of claim 8, further comprising:

an adjustment sleeve attached to said lower end of said cap screw adjacent said valve port; and wherein said movement of said impact assembly comprises axial movement.

10. The impact tool of claim 9, wherein said outer compression spring is pre-tensioned for operation by manipulation of said adjustment sleeve.

11. The impact tool of claim 10, further comprising:

a connection member, wherein said adjustment sleeve is contained on said lower end of said cap screw by said connection member.

12. The impact tool of claim 8, further comprising:

a lock nut attached to said upper end of said cap screw proximate said outer compression spring; and wherein said inner compression spring is smaller in length and width than said outer compression spring.

13. The impact tool of claim 12, wherein said outer compression spring is pre-tensioned for operation by manipulation of said lock nut.

14. The impact tool of claim 8, wherein said inner compression spring is less compressible than said outer compression spring.

15. The impact tool of claim 8, wherein said impact assembly is comprised of:

a piston;

a mandrel;

said piston operationally connected to said mandrel;

said piston adjacent said lower end of said cap screw;

wherein said lower end of said cap screw and said piston create a functional seal prior to the downstroke of said impact tool.

16. The impact tool of claim 15, wherein said outer sleeve is comprised of:

an upper sub;

a barrel having an upper end and a lower end;

said upper sub connected to said upper end of said barrel;

a lower sub;

said lower sub connected to said lower end of said barrel; and wherein said main compression spring is disposed intermediate said lower sub and said piston.

17. The impact tool of claim 16, further comprising:

a fluid inlet member;

said fluid inlet member operationally connected to said upper sub proximate said upper end of said cap screw;

at least one fluid port disposed in said fluid inlet member;

said fluid inlet member having an internal bore at least partially extending therethrough; and wherein said at least one fluid port is in fluid communication with said internal bore of said fluid inlet member.

18. An impact tool, comprising:

an outer sleeve having a hammer surface and an interior sleeve surface;

an impact assembly having an impact surface proximate said hammer surface, a shaft wall, and an internal bore at least partially extending therethrough;

said impact assembly being axially and rotatably movable in relation to said outer sleeve;

said impact assembly at least partially retained within said outer sleeve;

at least one opening provided in said shaft wall wherein said at least one opening is in fluid communication with said internal bore;

said at least one opening having an opening axis wherein said opening axis is angularly oriented toward said interior sleeve surface;

a main compression spring;

a valve assembly;

said main compression spring slidably disposed along said impact assembly intermediate said impact surface and said valve assembly;

wherein said valve assembly comprises;

a cap screw having an upper end and a lower end;

a valve port having at least one peripheral bore allowing fluid passage therethrough, wherein said valve port is slidingly disposed in relation to said cap screw;

an outer compression spring, and an inner compression spring slidably disposed within said outer compression spring; and said inner compression spring and said outer compression spring concentrically positioned around said cap screw in a slidable relation intermediate said valve port and said upper end of said cap screw.

19. The impact tool of claim 18, further comprising:

an adjustment sleeve attached to said lower end of said cap screw adjacent said valve port;

wherein said outer compression spring is pre-tensioned for operation by manipulation of said adjustment sleeve in relation to the lower end of said cap screw;

a connection member, wherein said adjustment sleeve is contained on said lower end of said cap screw by said connection member;

a lock nut attached to said upper end of said cap screw proximate said outer compression spring;

wherein said inner compression spring is smaller in length and width than said outer compression spring; and wherein said inner compression spring is less compressible than said outer compression spring.

20. The impact tool of claim 18, further comprising:

said impact assembly comprising; a piston; a mandrel; said piston operationally connected to said mandrel; said piston adjacent said lower end of said cap screw;

wherein said lower end of said cap screw and said piston create a functional seal prior to the downstroke of the impact tool;

said outer sleeve comprising; an upper sub; a barrel having an upper end and a lower end; said upper sub connected to said upper end of said barrel; a lower sub; said lower sub connected to said lower end of said barrel;

wherein said main compression spring is disposed intermediate said lower sub and said piston;

a gap between said mandrel and said lower sub which allows fluid flow from said internal bore of said impact assembly, through said at least one opening, and out of said gap.

* * * * *